US008186024B2

(12) United States Patent
Hatsios et al.

(10) Patent No.: US 8,186,024 B2
(45) Date of Patent: May 29, 2012

(54) O-CLIP VERTICAL SUPPORT FASTENER

(76) Inventors: Anastasios George Hatsios, Buffalo, NY (US); George Donald Hatsios, Amherst, NY (US)

( * ) Notice: Subject to any disclaimer, the term of this patent is extended or adjusted under 35 U.S.C. 154(b) by 413 days.

(21) Appl. No.: 12/459,610

(22) Filed: Jul. 6, 2009

(65) Prior Publication Data

US 2011/0000055 A1 Jan. 6, 2011

(51) Int. Cl.
*A44B 99/00* (2010.01)

(52) U.S. Cl. ..... 24/457; 24/598.8; 24/458

(58) Field of Classification Search ..... 24/599.1, 24/598.3, 598.4, 598.7, 598.8, 457, 458; 59/84, 85; 294/82.23
See application file for complete search history.

(56) References Cited

U.S. PATENT DOCUMENTS 1,005,370 A * 10/1911 Turney ..... 24/598.8
1,269,733 A * 6/1918 Nelson ..... 59/85
3,132,395 A * 5/1964 Luketa ..... 24/598.8
* cited by examiner

*Primary Examiner* — Robert J Sandy

(57) ABSTRACT

A vertical support 'O' shaped fastener clip for temporarily securing vertical supplemental support cables to horizontal main support cables within elevated work decks which are temporarily installed upon structures such as a bridge to perform work on said structure. The vertical support 'O' shaped fastener clip which can be installed by tightening a single bolt, is comprised of a rod bent in a general shape similar to the letter 'C' with a threaded means at least at one end and a hollow tube attached to the other end, a bolt inserted through the hollow tube with a coupling nut threaded onto the end of the bolt. The hollow tube, bolt and coupling nut are aligned so that the coupling nut may be threaded onto the threaded end of the bent rod to close the open side of the 'C' shaped rod and form a closed 'O' shape. A generally flat cover plate with at least two openings in it to allow the bent rod to pass through so that when two separate cables on either side of a deck panel are secured together by means of the 'O' shaped fastener clip through an opening in the deck panel, the plate covers the opening in the deck panel thus preventing debris form escaping the work deck area.

1 Claim, 5 Drawing Sheets

O-CLIP VERTICAL SUPPORT FASTENER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention relates to work deck platform systems which are installed temporarily under or upon structures such as bridges to allow workers and equipment to repair and renovate said structure and more particularly to an improved fastener clip for temporarily attaching vertical supplemental support cables to the horizontal main support cables providing faster and easier installation of the temporary work platform.

Current vertical supplemental support cables are attached to horizontal main support cables in several ways. One common means involves using opposing double U-bolt shaped hardware whereby one U-portion is bolted to the vertical supplemental support cable and the opposing U-portion is bolted to the horizontal main support cable. Both U-portions are attached to a steel plate between them which prevent the cables from disconnecting and cover the hole in the work deck floor where the cables are allowed to attach through.

The fastening hardware of known current means consists of multiple parts which must be assembled by the worker and then held in place until securely tightened using hand tools. With the fastening hardware consisting of multiple parts the installation process is awkward, as the worker must assemble the hardware, then hold it in place while also grabbing the hand tools and tightening the hardware.

The installation process is time consuming and there is also opportunity for pieces of hardware to be dropped during installation allowing metal to fall to the ground, highway or water below creating a danger to motorists, persons and property below.

Also work deck platforms are normally installed at elevated heights where workers have a limited surface area to stand upon and work from and whereby the less equipment and movement required the easier and safer their job becomes.

BRIEF SUMMARY OF THE INVENTION

It is the object of this invention to provide a pre-assembled vertical support fastener clip which can be used to temporarily attach vertical support cables to horizontal support cables with the installer having to tighten only one bolt to complete the installation.

In summary the O-clip vertical support fastener of this invention consists of round bar bent into the shape of the letter 'C' with one end of the round bar threaded and the opposing end having a steel tube welded to it along it's length. A long bolt is inserted through the steel tube and a coupling nut is partially threaded onto the bolt and welded in place. The bolt and tube are such that the bolt moves freely inside the tube but is prevented from passing completely through the tube by the bolt head in one direction and the coupling nut in the opposite direction. The 'C' shaped round bar is bent slightly offset so that the coupling nut which is welded onto the bolt is in proper alignment to thread onto the threaded end of the round bar as the bolt moves down through the tube. A steel plate with two holes is placed onto the round bar such that the threaded end of the round bar passes through both holes so that when the 'C' shaped round bar is placed in a generally vertical position the steel plate rests in a generally horizontal position. In this way the steel plate covers the opening in the deck panel floor while one portion of the round bar protrudes through the deck opening to hook the horizontal main cable and the opposite end of the round bar hooks the vertical cable. The bolt and coupling nut close the open side of the 'C' to form a generally 'O' shape when the coupling nut is threaded onto the threaded end of the round bar coupling the threaded end of the round bar and the bolt. By completing the closed circular shape of the vertical support fastener, the bolt and coupling nut temporarily lock together the ends of the round bar to temporarily lock together the vertical support cable and the horizontal main support cable.

Hardware dimensions are partially dependant on the size of the cables that are to be connected together. A typical O-clip vertical support fastener of this invention used to attach a ½"-steel wire rope vertical support cable to a ⅝"-steel wire rope horizontal main support cable would have hardware approximately of the dimensions; Bolt-½"diameter×6" length grade-5 steel bolt threaded to fit coupling nut; Coupling Nut-½"×1-¾" length; Tube-1-¾" diameter×2" length 14 gauge steel tube; Cover Plate-1-½"×9"×⅛" steel plate; Round bar-½" round bar steel approximately 17" length bent at both ends 180-degrees around a 1-⅛" inside diameter with one end threaded to fit coupling nut. The diameter of the bends in the round bar may be increased to accept larger cable. The diameter, sizes and material composition of the round bar, coupling nut, bolt and tube may be increased to increase the capacity and strength of the vertical support fastener clip of this invention. For example 1" round bar, 1" bolt and 1" coupling nut would have more strength than ½" round bar, ½" bolt and ½" coupling nut; and composite materials may have more strength than steel.

DETAILED DESCRIPTION OF THE INVENTION

Figure 1:
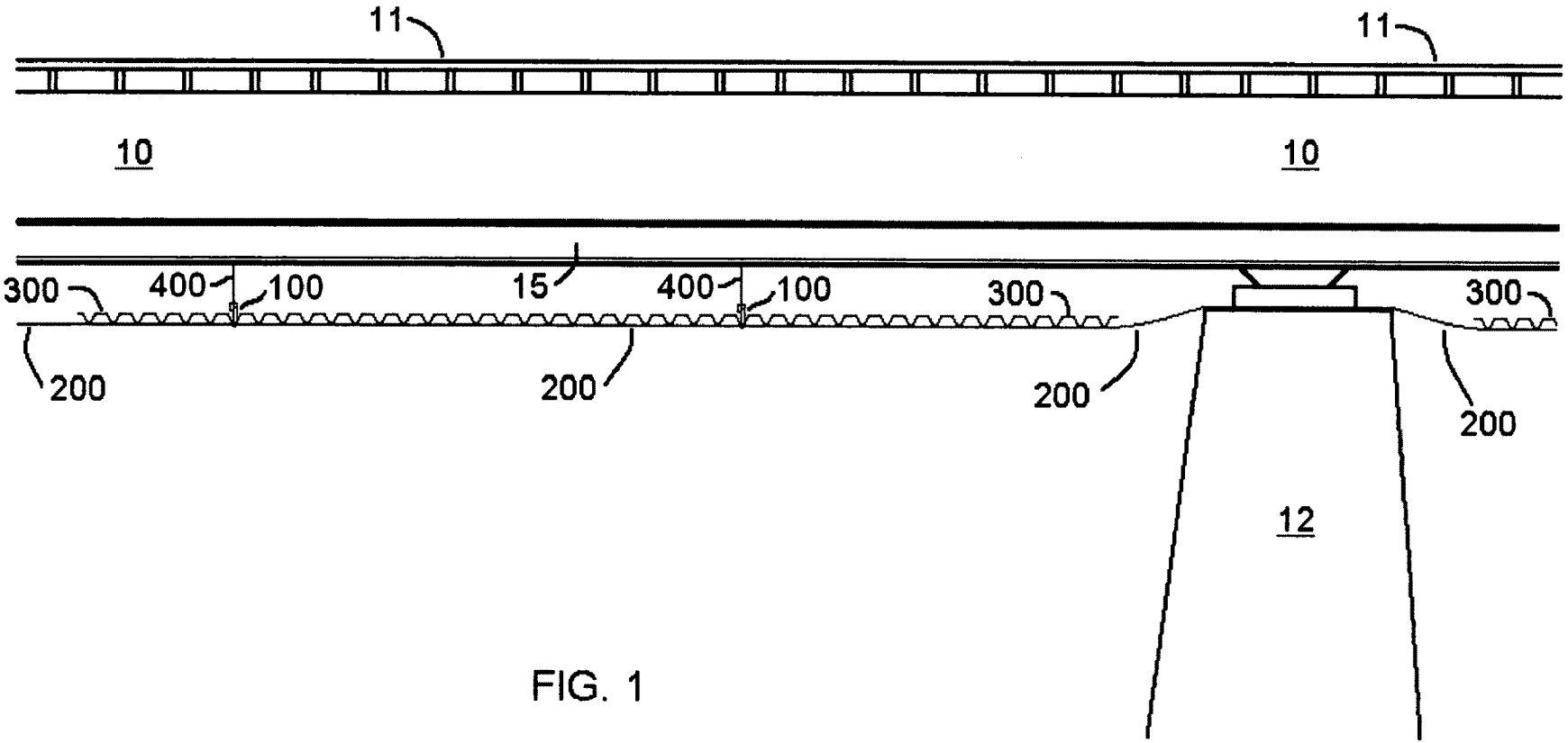
FIG. 1. Is a fragmentary elevated side view of a typical work platform consisting of horizontal main support cable 200, vertical supplemental support cable 400, and corrugated steel deck panels 300 installed under a bridge structure 10, 11 and 15; And showing the location of the O-Clip Vertical Support Fastener 100 of this invention.
Figure 2:
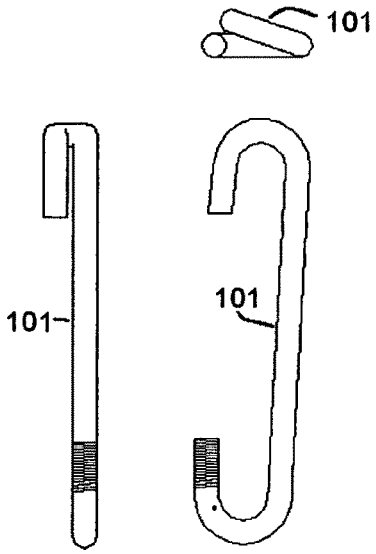
FIG. 2. Shows three alternate views of the bent round bar 101 prior to assembly into the O-Clip Vertical Support Fastener of this invention.
Figure 3:
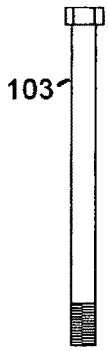
FIG. 3. Shows a side view of the bolt 103 prior to assembly into the O-Clip Vertical Support Fastener of this invention.
Figure 4:
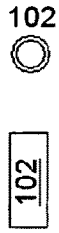
FIG. 4. Shows two alternate views of the tube 102 prior to assembly into the O-Clip Vertical Support Fastener of this invention.
Figure 5:
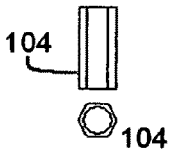
FIG. 5. Shows two alternate views of the coupling nut 104 prior to assembly into the O-Clip Vertical Support Fastener of this invention.
Figure 6:
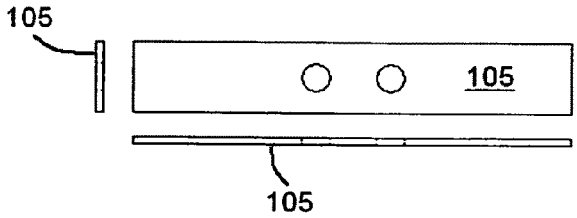
FIG. 6. Shows three alternate views of the cover plate 105 prior to assembly into the O-Clip Vertical Support Fastener of this invention.

Referring to FIGS. 2, 3, 4, 5 and 6 there is shown the parts prior to assembly which comprise the O-Clip Vertical Support Fastener of this invention. The bent round bar threaded at one end 101 is shown in FIG. 2; the bolt 103 is shown in FIG. 3; the tube 102 is shown in FIG. 4; the coupling nut 104 is shown in FIG. 5 and the cover plate 105 is shown in FIG. 6.

Figure 7:
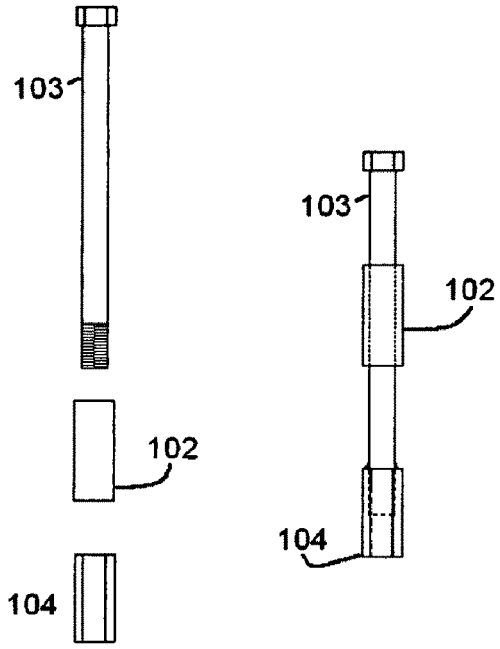
FIG. 7. Shows the tube 102, bolt 103, and coupling nut 104 prior to assembly and also assembled with the bolt 103 inserted into the tube 102 and attached to the coupling nut 104.

Referring to FIG. 7 there is shown the assembly of the bolt 103, tube 102 and coupling nut 104. The bolt 103 is inserted through the tube 102 and partially rotated in to the coupling nut 104. The bolt 103 is secured to the coupling nut 104 by weld or other attachment means to prevent separation of the bolt 103 and coupling nut 104. The bolt 103 moves freely within the tube 102.

Figure 8:
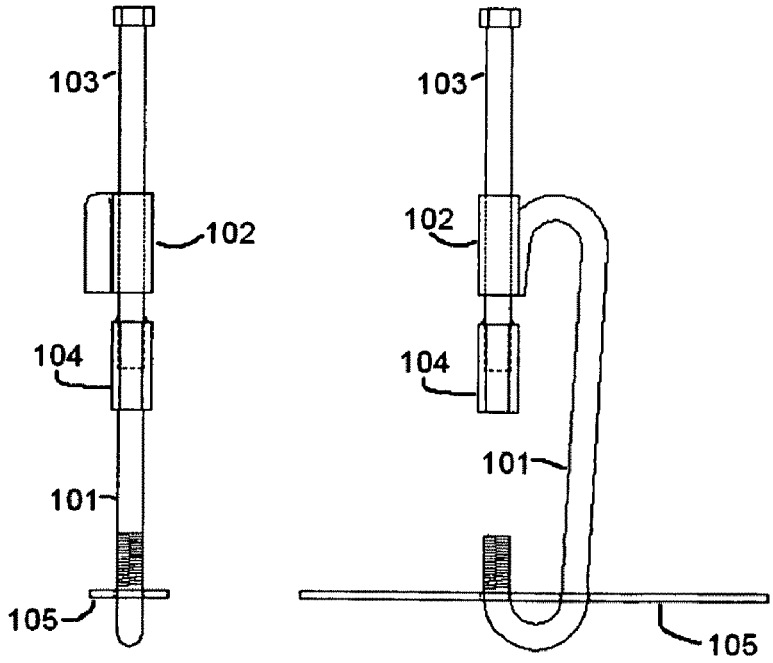
FIG. 8. Shows two views of the O-Clip Vertical Support Fastener of this invention showing the bolt 103, tube 102, and coupling nut 104 assembly of FIG. 7 attached to the round bar 101; and also showing the cover plate 105 fitted onto the round bar 101.
Figure 11:
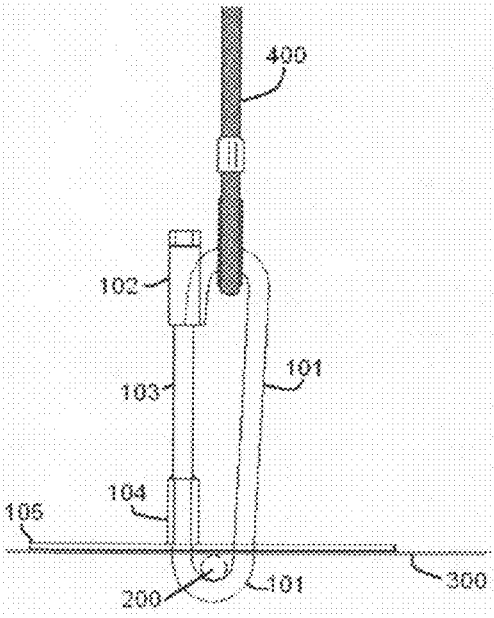
FIG. 11. Is a side view showing the O-Clip Vertical Support Fastener of FIG. 10 with the bolt assembly (102, 103, 104) tightened in place onto the threaded end of the round bar 101.
Figure 12:
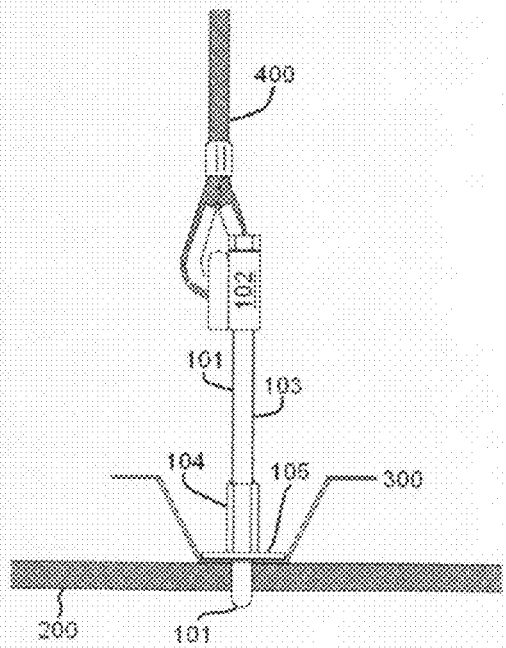
FIG. 12. Is an alternate view of FIG. 11 showing the O-Clip Vertical Support Fastener positioned in the corrugation of the deck panel 300.
Figure 13:
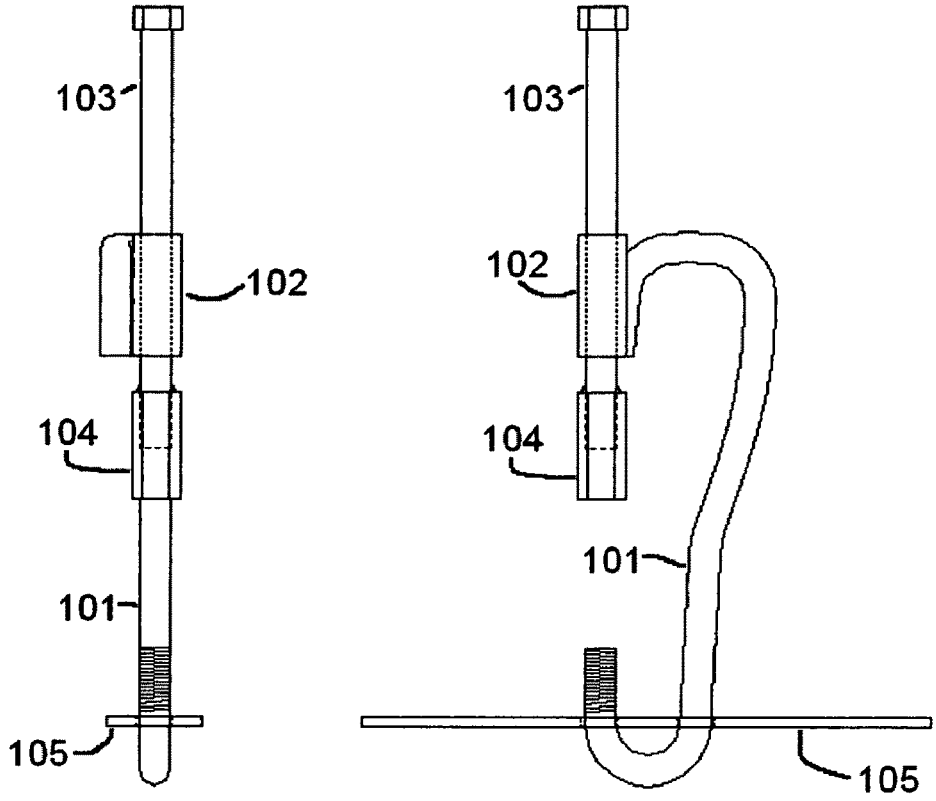
FIG. 13. Shows two views of an alternate version of the O-Clip Vertical Support Fastener where by the round bar 101 is shaped such that the upper curved portion has a larger radius then the lower curved portion.
Figure 14:
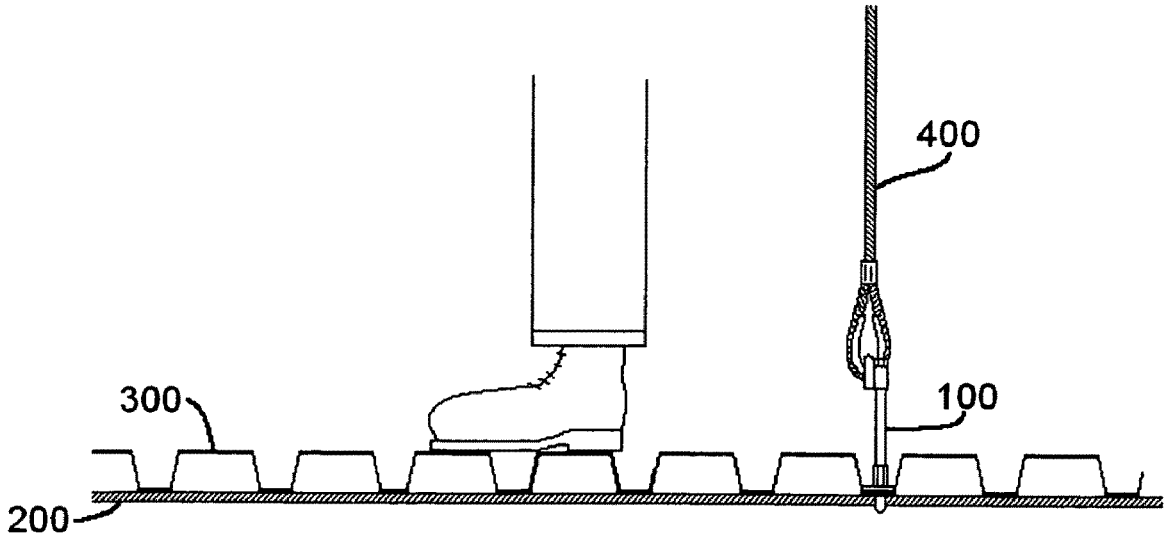
FIG. 14, Is a fragmentary side view of a typical platform deck showing the main support cable 200, decking 300, vertical supplemental support 400, and the O-Clip Vertical Support Fastener of this invention 100; along with a fragmentary illustration of a worker standing on the platform deck.

Referring to FIG. 8 there is shown the assembled O-Clip Vertical Support Fastener of this invention. The bolt 103, tube 102, coupling nut 104 assembly of FIG. 7 is attached to the bent round bar 101 at the tube 102. The tube 102 is affixed to the non-threaded end of the round bar 101 by weld or other attachment means. The tube 102 is secured to the round bar 101 in a position such that the bolt 103 and coupling nut 104 are in alignment with the threaded end of the round bar 101 so that the coupling nut 104 may be rotated on to the threaded end of the round bar 101 by rotating the bolt. In this way the bolt 103 and coupling nut 104 connect the two ends of the round bar 101 to form a closed ring as shown in FIG. 11.

Figure 9:
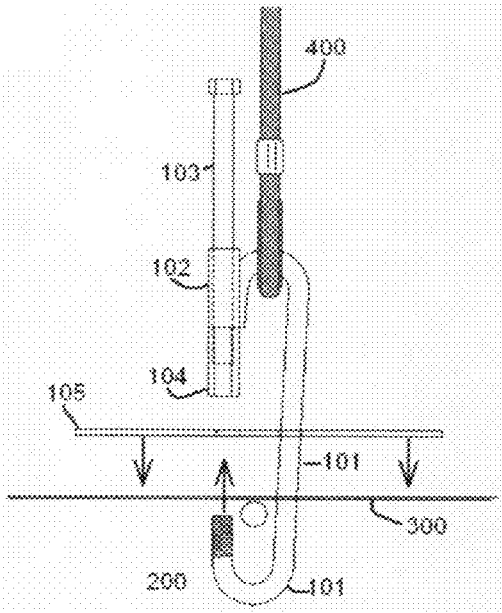
FIG. 9. Is a side view showing the O-Clip Vertical Support Fastener of this invention with the vertical supplemental support cable 400 attached at the curved upper portion of the round bar 101; and showing the curved lower portion of the round bar 101 protruding below the deck panel 300 to grasp the horizontal main support cable 200. The cover plate 105 is shown in an elevated position so as to allow the curved lower portion of the round bar 101 to grasp the main cable 200.
Figure 10:
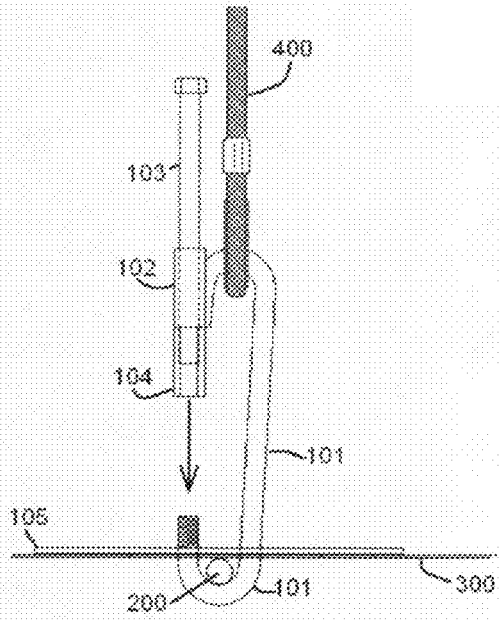
FIG. 10. Is a side view showing the O-Clip Vertical Support Fastener of FIG. 9 pulled upward into a position grasping the main support cable 200; with the cover plate 105 fitted into position to cover the opening in the deck panel.

The O-Clip Vertical Support Fastener of this invention is a means to connect the vertical supplemental support cable to the horizontal main support cable. FIGS. 9, 10 and 11 illustrates the O-Clip Vertical Support Fastener connecting the vertical supplemental support cable 400 to the horizontal main support cable 200 to provide additional support to the deck panel 300. Referring to FIGS. 9, 10, 11 and 12; there is shown a fragmentary view of a deck panel 300 supported on a main cable 200. The O-Clip Vertical Support Fastener connects to the vertical supplemental support cable 400 at the non-threaded curved end of the bent rod 101. The curved threaded end of the bent rod 101 is inserted through an opening in the deck panel 300 so that it protrudes below the main cable 200 as shown in FIG. 9. The O-Clip Vertical Support Fastener is pulled upward so that the threaded curved end of the bent rod 101 hooks the main support cable 200 as shown in FIG. 10. The cover plate 105 is dropped down and positioned on top of the deck panel 300 to cover the opening in the deck panel 300. The curved threaded end of the bent rod is such that it passes through one opening in the cover plate 105, then thru the opening in the deck panel 300 around the main cable 200 and back up through the opening in the deck panel 300 and through the second opening in the cover plate 105, so that the threaded portion of the bent rod 101 protrudes above the cover plate 105 as shown in FIG. 10. The bolt 103 is pushed downward through the tube 102 and rotated so that the coupling nut 104 attaches on to the threaded end of the bent rod 101 to connect the ends of the bent rod 101 as shown in FIG. 11 and securing the vertical supplemental support cable 400 to the horizontal main support cable 200.

What is claimed is:

1. A vertical support fastener clip for temporarily securing vertical supplemental support cables to horizontal main support cables within elevated work decks which are temporarily installed upon structures such as a bridge to perform work on said structure, the vertical support fastener clip comprising:

a) a rod with a threaded means at least at one end thereof, the rod bent in a general incomplete oval shape with one side left open similar to the letter 'C';

b) a hollow tube attached to another end of the rod in alignment with the threaded means of the one end of the rod;

c) a bolt inserted through the hollow tube and then a coupling nut threaded about halfway onto a threaded end of the bolt and secured into position on the bolt such that a head of the bolt and the coupling nut prevent the bolt from passing completely through the hollow tube in either direction, the hollow tube, bolt and coupling nut are aligned so that the coupling nut may be threaded onto the threaded end of the bent rod to close the open side of the 'C' shaped rod and form the fastener clip into a closed 'O'; and d) a generally flat cover plate with at least two openings therethrough to allow the bent rod to pass through one of the openings and back through another of the other openings so that when the bent rod, hollow tube, bolt and coupling nut form the closed 'O' shape, a portion of the bent rod which forms the bottom of the 'O ' shape is below the cover plate, and a remainder portion of the bent rod, the hollow tube, bolt and coupling nut forming the closed 'O ' shape is on a top side of the cover plate, thus allowing two or more separate cables on either side of a deck panel to be secured to one another by the 'O ' shaped fastener clip protruding through an opening in the deck panel and having the flat plate cover the opening in the deck panel which the 'O ' shaped fastener clip protrudes through.

* * * * *